US007293417B2

(12) United States Patent
Baudat

(10) Patent No.: US 7,293,417 B2
(45) Date of Patent: Nov. 13, 2007

(54) METHODS AND APPARATUS FOR PROCESSING, TRANSPORTING AND/OR STORING CRYOGENIC FLUIDS

(75) Inventor: Ned Baudat, New Braunfels, TX (US)

(73) Assignee: Mustang Engineering, L.P., Houston, TX (US)

( * ) Notice: Subject to any disclaimer, the term of this patent is extended or adjusted under 35 U.S.C. 154(b) by 404 days.

(21) Appl. No.: 10/777,506

(22) Filed: Feb. 11, 2004

(65) Prior Publication Data

US 2005/0120723 A1 Jun. 9, 2005

(51) Int. Cl.
*F17C 3/08* (2006.01)
*F17C 7/02* (2006.01)
*F17C 9/02* (2006.01)

(52) U.S. Cl. ..... 62/45.1; 62/50.1; 62/50.2

(58) Field of Classification Search ..... 62/45.1, 62/50.1, 50.2, 53.1, 259.1, 260; 220/560.03, 220/901; 165/47, 53; 52/192; 405/56
See application file for complete search history.

(56) References Cited

U.S. PATENT DOCUMENTS

| | | | | | |
|---|---|---|---|---|---|
| 2,332,227 | A | * | 10/1943 | Jackson | 405/131 |
| 2,964,917 | A | * | 12/1960 | Webster | 62/50.3 |
| 3,047,184 | A | * | 7/1962 | Van Bergen et al. | 220/560.12 |
| 3,076,317 | A | * | 2/1963 | La Fave | 405/131 |
| 3,225,552 | A | * | 12/1965 | Farkas | 62/50.2 |
| 3,274,785 | A | * | 9/1966 | Lange | 405/131 |
| 3,448,886 | A | * | 6/1969 | Gordon et al. | 220/560.12 |
| 3,675,431 | A | | 7/1972 | Jackson | 61/46 |
| 3,727,418 | A | | 4/1973 | Glazer | 62/45 |
| 3,791,164 | A | * | 2/1974 | Laverman | 62/48.3 |
| 3,828,565 | A | | 8/1974 | McCabo | 62/45 |
| 3,930,590 | A | * | 1/1976 | Ebbrell | 220/560.03 |
| 3,986,340 | A | * | 10/1976 | Bivins, Jr. | 62/50.2 |
| 4,041,722 | A | | 8/1977 | Tertesky | 62/45 |
| 4,209,267 | A | * | 6/1980 | Gnaedinger | 405/53 |
| 4,374,478 | A | | 2/1983 | Secord et al. | 73/863.31 |
| 5,682,750 | A | | 11/1997 | Preston et al. | 62/50.2 |
| 6,199,329 | B1 | * | 3/2001 | Witter | 52/167.7 |
| 6,640,554 | B2 | | 11/2003 | Emmer et al. | 62/45.1 |

FOREIGN PATENT DOCUMENTS

| | | | | |
|---|---|---|---|---|
| JP | 51120422 | A | * | 10/1976 |
| JP | 53132610 | A | * | 11/1978 |
| JP | 09177359 | A | * | 7/1997 |

* cited by examiner

*Primary Examiner*—Cheryl Tyler
*Assistant Examiner*—B. Clayton McCraw
(74) *Attorney, Agent, or Firm*—Gilbreth Roebuck; J. M. Gilbreth; M. A. Gilbreth

(57) ABSTRACT

A cryogenic fluid storage/processing system which includes a tank for storing the cryogenic fluid, and a containment wall surrounding the tank and defining an impoundment area. The system further includes a vaporizer for regasification of the cryogenic fluid. Piping is discharges the vaporizer heating medium into the impoundment area, and/or routes it beneath the tank to heat the ground beneath the tank. Further, the system provides for all liquid hydrocarbons to be contained within the impoundment area with the pumps inside and the vaporizers mounted on the containment walls.

21 Claims, 3 Drawing Sheets

METHODS AND APPARATUS FOR PROCESSING, TRANSPORTING AND/OR STORING CRYOGENIC FLUIDS

BACKGROUND OF THE INVENTION

1. Field of the Invention

The present invention relates to cryogenic fluids. In another aspect, the present invention relates to methods and apparatus for processing, transporting and/or storing cryogenic fluids. In even another aspect, the present invention relates to receiving and/or dispensing terminals for cryogenic fluids and to methods of receiving, dispensing and/or storing cryogenic fluids. In still another aspect, the present invention relates to methods and apparatus for processing, transporting and/or storing liquified natural gas ("LNG").

2. Description of the Related Art

Interest in the use of liquified natural gas (LNG) as a fuel for motor vehicles has increased dramatically in recent years. Entire fleets of government and industrial vehicles have successfully been converted to natural gas. Some privately-owned vehicles have been converted as well. Congress has passed an energy bill that requires increased use of alternative fuels in government and private fleets. Several factors have influenced this increasing use of LNG as a fuel in motor vehicles. LNG is relatively inexpensive. In addition, it burns very cleanly, making it much easier for fleets to meet more restrictive pollution emission standards. And, in terms of reducing dependence on imported oil, natural gas is abundantly available in the United States.

Most conveniently, natural gas is transported from the location where it is produced to the location where it is consumed by a pipeline. However, given certain barriers of geography, economics, and/or politics, transportation by pipeline is not always possible, economic or permitted. Without an effective way to transport the natural gas to a location where there is a commercial demand, the gas may be burned as it is produced, which is wasteful.

Liquefaction of the natural gas facilitates storage and transportation of the natural gas (a mixture of hydrocarbons, typically 65 to 99 percent methane, with smaller amounts of ethane, propane and butane). When natural gas is chilled to below its boiling point (in the neighborhood of −260° F. depending upon the composition) it becomes an odorless, colorless liquid having a volume which is less than one six hundredth (1/600) of its volume at ambient atmospheric surface temperature and pressure. Thus, it will be appreciated that a 150,000 cubic meter LNG tanker ship is capable of carrying the equivalent of 3.2 billion cubic feet of natural gas.

When LNG is warmed above its boiling point, it boils reverting back to its gaseous form.

The growing demand for natural gas has stimulated the transportation of LNG by special tanker ships. Natural gas produced in remote locations, such as Algeria, Borneo, or Indonesia, may be liquefied and shipped overseas in this manner to Europe, Japan, or the United States. Typically, the natural gas is gathered through one or more pipelines to a land-based liquefaction facility. The LNG is then loaded onto a tanker equipped with cryogenic compartments (such a tanker may be referred to as an LNG carrier or "LNGC") by pumping it through a relatively short pipeline. After the LNGC reaches the destination port, the LNG is offloaded by cryogenic pump to a land-based regasification facility, where it may be stored in a liquid state or regasified. If regasified, the resulting natural gas then may be distributed through a pipeline system to various locations where it is consumed.

Of the known liquid energy gases, liquid natural gas is the most difficult to handle because it is so intensely cold. Complex handling, shipping and storage apparatus and procedures are required to prevent unwanted thermal rise in the LNG with resultant regassification. Storage vessels, whether part of LNG tanker ships or land-based, are closely analogous to giant thermos bottles with outer walls, inner walls and effective types and amounts of insulation in between.

LNG storage tanks in the United States have heretofor been built mostly above the ground with some frozen pit facilities properly characterized as mostly above the ground. Most such tanks have been enclosed by a low rising earthen dike. Such dikes were sized and placed to enclose an area and volume at least as great as the storage capacity of the largest tank (if not all of the tanks) within the diked area.

In addition, National Fire Protection Association (NFPA) guidelines (NFPA 59A, Para 108) for spill containment require impounding areas that hold the entire LNG capacity of the station in the event of a catastrophic spill. Furthermore, in accordance with NFPA guidelines, electrical controls must either be designed for explosion-proof conditions or be situated in designated safe areas outside of the impoundment area generally several hundred feet away. As explosion-proof controls are costly, the latter option is preferable.

Thus, LNG to be regasified is generally pumped to a heating device situated outside the impoundment area several hundred feet away in a designated safe area.

In spite of the presence of insulation, storage tanks will still cool if not freeze any ground in direct contact with the tank. Thus, an electrical heating element is placed in the ground to counter any cooling by the tank.

A number of patents relate to the processing, transporting, and storing of LNG.

U.S. Pat. No. 3,675,431 issued Jul. 11, 1972 to Jackson, discloses a partially submerged offshore storage tank for liquified energy gases. That patent described an insulated tank which was prefabricated, floated to a suitable offshore site and then sunk until its submerged base rested on the floor of the sea. An upper above-the-water domed metal cylinder extended from a concrete base. Insulation lined the interior of the tank. A thin and flexible membrane inside the insulation provided the required liquid tight interior lining of the tank. The insulation lining the submerged portion of the tank was said to be thinned, so that a layer of ice formed around the outside of the concrete base when the tank was filled with liquified gas. In accordance with the invention claimed in the patent, the ice layer supposedly acted as an outer seal for the submerged concrete.

U.S. Pat. No. 3,727,418, issued Apr. 17, 1973, to Glazier, discloses an LNG storage facility having an insulated interior membrane. A balancing fluid, said to be isopentane (2-methyl butane) transferred hydrostatic pressure from surrounding ambient water to the LNG contents.

U.S. Pat. No. 3,828,565, issued Aug. 13, 1974 to McCabe, discloses an insulated buoyant tank moved telescopically up and down in a larger receiver tank containing seawater, oil or other liquid in accordance with the quantity of LEG at atmospheric pressure stored therein from time to time.

U.S. Pat. No. 4,041,722, issued Aug. 16, 1977, to Terlesky et al., discloses an impact resistant tank for storing cryogenic fluids, includes an inner metal tank having a metal side wall and a metal bottom and a concrete outer wall around the inner metal wall and having reinforcement therein to resist impact loads thereon, and to serve as a secondary containment for the cryogenic fluid.

U.S. Pat. No. 4,209,267, issued Jun. 24, 1980, to Gnaedinger, proposes an improvement over the traditional earthen dike system around LNG storage tanks. Specifically, the storage system comprises a dike, impounding wall or drainage channel constructed of compacted earth, concrete, metal and/or other suitable substance surrounding an above-ground steel insulated tank used to store the liquefied gas. A drop shaft is used to communicate the diked area with an underground tunnel for temporary accumulation and subsequent safe disposal of liquid which has escaped from the storage tank.

U.S. Pat. No. 4,374,478, issued Feb. 22, 1983, to Secord et al., discloses tanks for land storage of liquefied gas at low temperature at or above atmospheric pressure. The invention provides a storage tank of the kind in which the walls are formed by a multiplicity of connected, parallel, part-cylindrical lobes presenting outwardly convex arcuate surfaces, which is characterized in that the side and end walls thereof are provided by a single tier of connected lobes, in that said lobes extend in one common direction over the tank, in that the end walls of the tank comprise part-spherical knuckles closing off the ends of the part-cylindrical lobes, and in that a separating plate is provided at each lobe connection to strengthen the tank against internal pressure and to divide it into separate storage compartments.

U.S. Pat. No. 5,682,750, issued Nov. 4, 1997, to Preston et al., discloses a portable self-contained delivery station for liquid natural gas (LNG) is provided on a movable skid frame and equipped with an instant on delivery system which may initiate LNG delivery immediately to a use vehicle. The skid is equipped with a spill containment feature such that the LNG may be contained in the event of spillage. A variable speed pump both controls LNG dispensing and saturation levels of the stored LNG. The pump is submerged in a sump tank which is separate from the bulk storage tank. The sump tank is flooded with an amount of LNG such that the pump is submerged. Delivery of LNG may thus occur instantly, without pre-cooling of the pump or associated meter.

U.S. Pat. No. 6,640,554, issued Nov. 4, 2003, to Emmer et al., discloses a portable self-contained liquid natural gas (LNG) dispensing system is housed in a container featuring opposing side and end walls and a bottom panel. The container is divided into a ventilated portion and a covered portion. A roof is over the covered portion while the ventilated portion features an open top. A bulk tank positioned within the container contains a supply of LNG with a head space thereabove and a pump is submerged in LNG within a sump that is also positioned within the container and communicates with the bulk tank. The container is lined with stainless steel sheets to define a containment volume that is capable of holding the entire supply of LNG in the bulk tank. A vent valve communicates with the head space of the bulk tank and is positioned under the open top of the ventilated portion of the container. The electric controls are positioned on the lower portion of the end wall of the covered portion of the container so as to be located in accordance with the appropriate safety guidelines.

All of the patents cited in this specification, are herein incorporated by reference.

However, in spite of the above advancements, there still exists a need in the art for apparatus and methods for processing, transporting, and/or storing LNG.

This and other needs in the art will become apparent to those of skill in the art upon review of this specification, including its drawings and claims.

SUMMARY OF THE INVENTION

It is an object of the present invention to provide for improved apparatus and methods for processing, transporting, and/or storing LNG.

This and other objects of the present invention will become apparent to those of skill in the art upon review of this specification, including its drawings and claims.

According to one embodiment of the present invention, there is provided an apparatus that includes a tank positioned on a foundation and a vaporizer in liquid communication with the tank. The vaporizer has a heat exchange medium inlet stream, and a heat exchange medium outlet stream. The heat exchange medium outlet stream is routed through the foundation. In a further embodiment of this embodiment, at least a portion but not all of the heat exchange medium inlet stream is routed through the foundation. In an even further embodiment of this embodiment, the system further comprises a containment wall surrounding the tank, with the vaporizer supported by the containment wall. In a still further embodiment, the system further comprises a containment wall surrounding the tank and defining a containment area between the tank and wall, with the vaporizer positioned within the containment area. In a yet further embodiment, the system comprises liquified natural gas contained within the tank.

According to another embodiment of the present invention, there is provided an apparatus that includes a tank surrounded by a containment wall defining a containment area between the tank and wall, and a vaporizer in liquid communication with the tank. The vaporizer includes a heat exchange medium inlet stream, and a heat exchange medium outlet stream. The heat exchange outlet stream is routed to discharge into the containment area. According to further embodiments of this embodiment: (1) the tank is positioned on a foundation, the apparatus further comprising a blower positioned to intake from the containment area and to discharge through the foundation; (2) the vaporizer is supported by the containment wall; (3) the vaporizer is positioned in the containment area; and/or liquified natural gas is contained within the tank.

According to even another embodiment of the present invention, there is provided an apparatus that includes a tank positioned on a foundation, and surrounded by a containment wall defining a containment area between the tank and wall, and a vaporizer in liquid communication with the tank. The vaporizer further comprises a heat exchange medium inlet stream, and a heat exchange medium outlet stream, with a first portion of the heat exchange outlet stream routed through the foundation, and a second portion of the heat exchange outlet stream routed to discharge outside the containment area. According to further embodiments of this embodiment: (1) the vaporizer is mounted on the containment wall; (2) the vaporizer is positioned in the containment area; (3) at least a portion but not all of the heat exchange medium inlet stream is routed through the foundation; and/or (4) liquified natural gas is contained within the tank.

According to still another embodiment of the present invention, there is provided a method of vaporizing a cryogenic liquid contained within a tank positioned on a foundation. The method includes the steps of passing the cryogenic liquid from the tank to a vaporizer; introducing an inlet steam comprising heat exchange medium into the vaporizer to gasify the cryogenic liquid and cool the heat exchange medium; and, passing the cooled heat exchange medium through the foundation. According to further embodiments of this embodiment the method also includes: (1) passing at least a portion by not all of the inlet steam through the foundation; and/or (2) having the cryogenic liquid be liquified natural gas.

According to yet another embodiment of the present invention, there is provided a method of vaporizing a cryogenic liquid contained within a tank supported by a foundation and surrounded by a wall defining a containment area between the tank and the wall. The method includes the steps of passing the cryogenic liquid from the tank to a vaporizer; introducing an inlet steam comprising a heat exchange medium into the vaporizer to gasify the cryogenic liquid and cool the heat exchange medium; and, discharging the cooled heat exchange medium stream into the containment area. According to further embodiments of this embodiment the method also includes: (1) passing at least a portion by not all of the inlet steam through the foundation; (2) blowing air from the containment area through the foundation; and/or (3) having the cryogenic liquid be liquified natural gas.

According to even still another embodiment of the present invention, there is provided a method of vaporizing a cryogenic liquid contained within a tank supported by a foundation, and surrounded by a wall defining a containment area between the tank and the wall. The method includes the steps of passing the cryogenic liquid from the tank to a vaporizer; introducing an inlet steam comprising a heat exchange medium into the vaporizer to gasify the cryogenic liquid and cool the heat exchange medium; passing a first portion of the cooled heat exchange medium through the foundation; and, discharging a second portion of cooled heat exchange medium stream outside of the containment area. Further embodiments of this embodiment includes variations as shown herein for the other embodiments.

These and other embodiments of the present invention will become apparent to those of skill in the art upon review of this specification, including its drawings and claims.

BRIEF DESCRIPTION OF THE DRAWINGS

In the drawings, it should be understood that like reference numbers refer to like members.

DETAILED DESCRIPTION OF THE INVENTION

While some descriptions of the present invention may make reference to liquified natural gas ("LNG"), it should be understood that the present invention is not limited to utility with LNG, but rather has broad utility with cryogenic fluids in general, preferably cryogenic fluids formed from flammable gases.

The apparatus of the present invention will find utility for processing, storing, and/or transporting (i.e., including but not limited to, receiving, dispensing, distributing, moving) cryogenic fluids, a non-limiting example of which is liquified natural gas ("LNG").

The apparatus of the present invention includes cryogenic storage apparatus. The apparatus of the present invention also includes apparatus for cryogenic processing and/or transporting.

Figure 1:
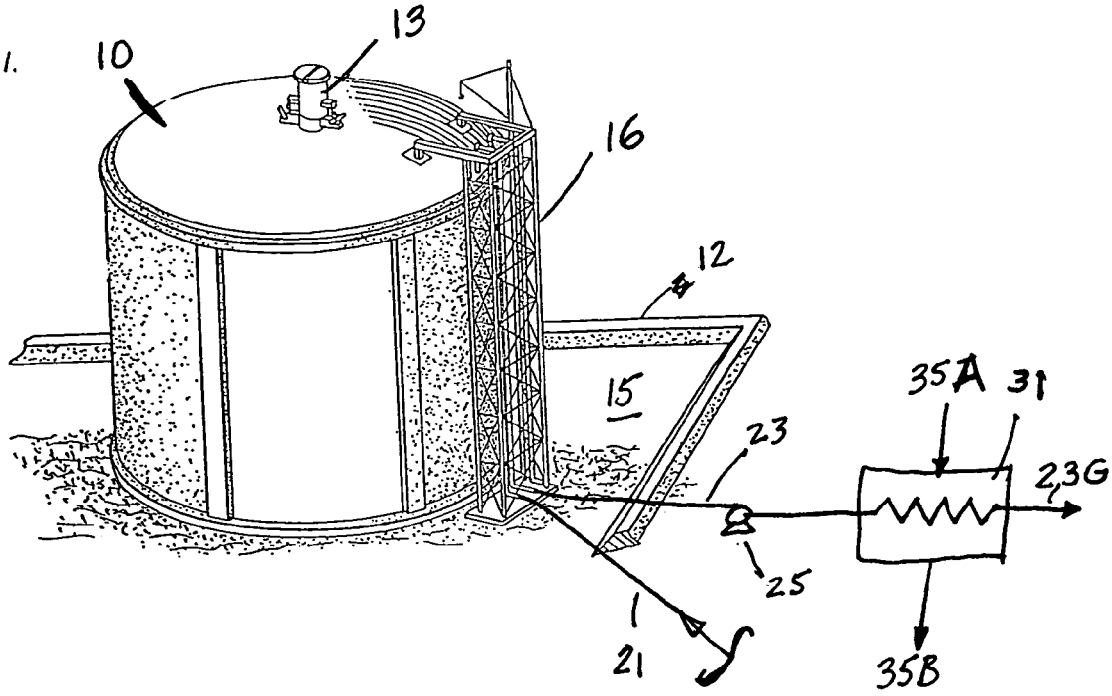
FIG. 1 shows a prior art cryogenic storage tank 10, having safety valve 13 and a suitable freestanding pipe tower 16 for supporting the required piping for filling 21 and piping for emptying 23 tank 10, and schematically shows pump 25 for pumping LNG from tank 10, and vaporizer 31 for vaporizing the LNG into natural gas.

The present invention will be explained by first making reference to the prior art. Referring first to FIG. 1, there is shown a prior art cryogenic storage tank 10, having safety valve 13 and a suitable freestanding pipe tower 16 for supporting the required piping for filling 21 and piping for emptying 23 tank 10.

Schematically shown are pump 25 for pumping LNG from tank 10, and vaporizer 31 for vaporizing liquid LNG stream 23 into natural gas stream 23G. Vaporizer 31, shown with heating media inlet stream 35A and heating media outlet stream 35B, is situated outside the impoundment area several hundred feet away in a designated safe area. Vaporizer 31 may be any suitable heat exchange device, most commonly an open rack vaporizer or ambient air vaporizer.

Completely surrounding tank 10 and defining impoundment area 15 is low rising containment dike 12. As is well known in the prior art, and as shown in FIG. 1, the height of containment dike 12 is significantly less than the height of tank 10. The impoundment area (more accurately "volume") 15 is defined between containment dike 12 and tank 10, and is sized sufficient to hold the entire contents of tank 10.

The present invention will now be discussed by reference to FIGS. 2–4, in which it should be understood that like reference numbers refer to like members.

Figure 2:
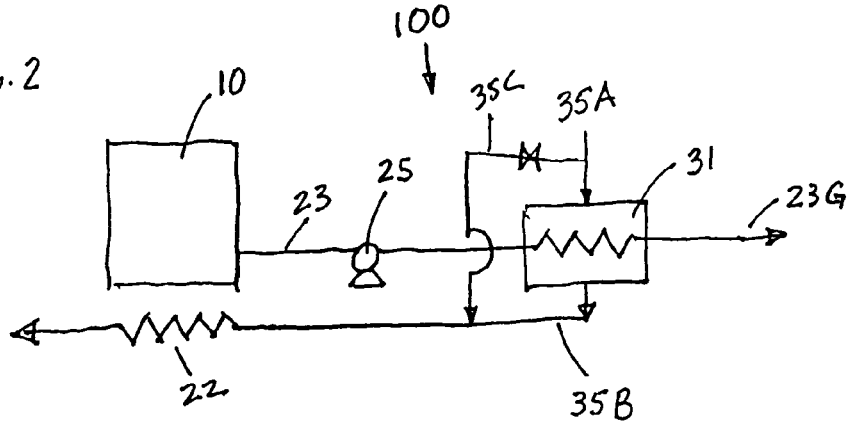
FIG. 2 shows a schematic representation of one non-limiting embodiment of cryogenic storage system 100 of the present invention and method of the present invention, showing cryogenic tank 10, emptying liquid LNG line 23, pump 25, vaporizer 31, and ground heater 22.

Referring now to FIG. 2, there is shown one non-limiting embodiment of cryogenic storage system 100 of the present invention and method of the present invention, showing cryogenic tank 10, emptying liquid LNG line 23, pump 25, vaporizer 31, and ground heater 22.

In operation, pump 25 is engaged to pump liquid LNG to be vaporized through emptying line 23 to vaporizer 31. Heat necessary to vaporize the LNG is provided by inlet line 35A carrying the heat exchange medium (most commonly air or water). Vaporizer 31 is operated in such a manner that the cooled heat exchange medium stream 35B still has sufficient heat to be used to warm the ground beneath tank 10. Generally, this means that the cooled heat exchange medium is sufficiently above the freezing point of water to keep the ground thawed. Thus, cooled heat exchange medium then proceeds via outlet piping 35B to be circulated beneath tank 10 forming heater 22. Any suitable arrangement of piping may be utilized for heater 22. For example, heat 22 piping may form a spiral pattern, or run beneath tank 10 in a back-and-forth manner, or any other suitable pattern or arrangement.

While the simplest manner of forming heater 22 will be to form piping into a suitable patter or arrangement, it is also contemplated that specialized baffles, manifolds or other heat exchange equipment as is known to those of skill in the heat exchange art may be utilized.

It should be understood that heater 22 may be used to completely replace the traditional electrical heaters used beneath LNG tanks, or may be used to supplement such traditional heaters. It should also be understood that it is not necessary to be vaporizing LNG in vaporizer 31 in order to operate heater 22.

As an alternative optional embodiment, optional piping 35C can be provided to allow all or part of stream 35A to by-pass vaporizer 31, for those instances where more heat is required in heater 22, or in those instances when vaporizer 31 is not vaporizing LNG. This optional piping can be utilized on the embodiments as shown in FIGS. 3 and 4.

With this embodiment, and those discussed below, rather than locate vaporizer 31 several hundred feet away from tank 10, only to then pipe vaporizer outlet 35B all the way back to tank 10, optionally, it is preferred to locate vaporizer 31 as close to tank 10 as possible.

As shown in FIG. 2, one embodiment of the method of the present invention, includes pumping the cryogenic fluid away from the tank in which it is stored, vaporizing the cryogenic fluid with a heat transfer medium in a manner sufficient to forming a cooled heat transfer medium that is still above 32° F., and then contacting this cooled heat transfer medium with the ground beneath the tank. Optional method steps include a partial or full by-pass of the vaporizer.

Figure 3:
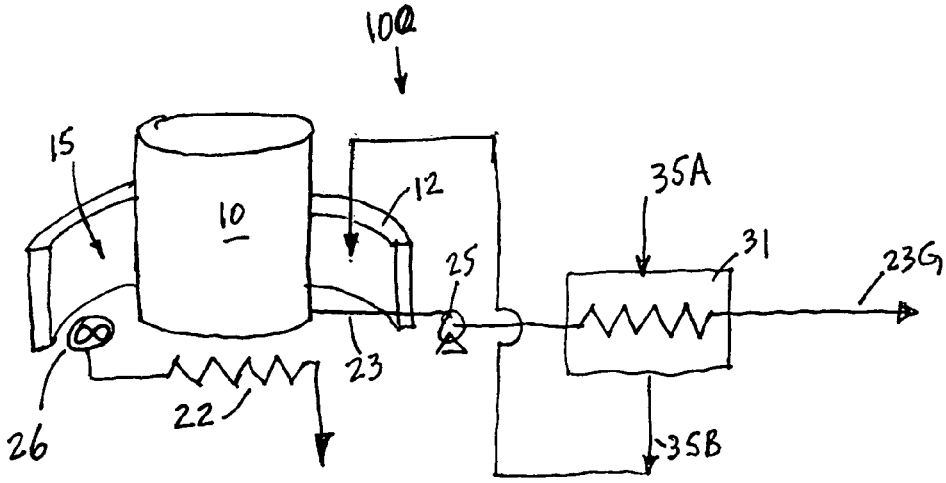
FIG. 3 shows a schematic representation of another non-limiting embodiment of cryogenic storage system 100 of the present invention, showing cryogenic tank 10, containment wall 12 defining impoundment area 15, emptying liquid LNG line 23, pump 25, and vaporizer 31.

Referring now to FIG. 3, there is shown another non-limiting embodiment of cryogenic storage system 100 of the present invention, showing cryogenic tank 10, containment wall 12 defining impoundment area 15, emptying liquid LNG line 23, pump 25, and vaporizer 31.

Unlike the low rising earthen containment walls of the prior art, containment wall 12 will generally be at least about 25% the height of tank 10, preferably in the range of about 25% to about 75% the height of tank 10, more preferably in the range of about 30% to about 50% the height of tank 10. While not wishing to be limited to exact heights, for many existing tanks which are on the order of 100 ft high, wall 12 will be in the range of about 30 ft to about 50 ft high.

With a higher containment wall 12, it should be understood that containment wall 12 may be positioned closer to tank 10 while still defining an impoundment volume 15 sufficient to hold the contents of tank 10.

As in the above embodiment shown in FIG. 2, pump 25 is engaged to pump liquid LNG to be vaporized through emptying line 23 to vaporizer 31. Heat necessary to vaporize the LNG is provided by inlet line 35A carrying the heat exchange medium (which in this embodiment is a gas, preferably air or an otherwise environmentally inert gas). In many instances, the cooled gas of outlet line 35B is sufficiently cooler than the ambient air, for example, on the order of 20° F. to 40° cooler, that environmental concerns might not allow for its discharge directly back to the environment.

To both use this cooled gas and to slightly heat it, cooled gas outlet line 35B can be discharged into impoundment area 15 where it serves to cool impoundment area 15 and thereby improve the cooling efficiency of tank 10.

As a further optional embodiment, cryogenic cooling system 100 may further include blower 26 positioned to blow air from impoundment area 15 to be circulated in piping beneath tank 10 forming heater 22 and warming the ground beneath tank 10.

As discussed above, rather than locate vaporizer 31 several hundred feet away from tank 10, only to then pipe vaporizer outlet 35B all the way back to tank 10, optionally, it is preferred to locate vaporizer 31 as close to tank 10 as possible.

Figure 6:
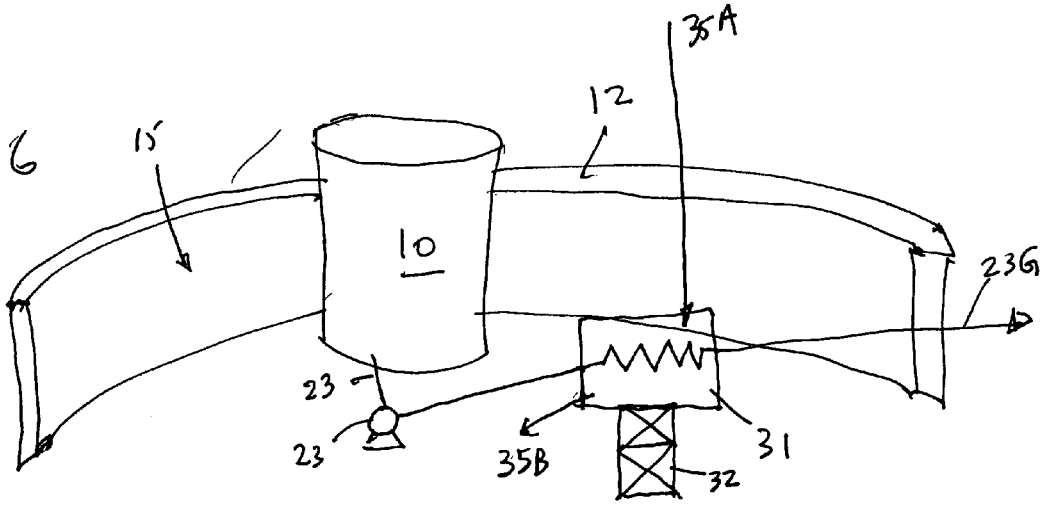
FIG. 6 is a schematic of another non-limiting embodiment of cryogenic storage system 100 of the present invention, showing cryogenic tank 10, containment wall 12 defining impoundment area 15, emptying liquid LNG line 23, pump 25, and vaporizer 31 mounted on support structure 32 and positioned within impoundment area 15.

Preferably, vaporizer 31, pump 25 and all related components are positioned within impoundment wall 12. Referring now to FIG. 6, there is shown a schematic of another non-limiting embodiment of cryogenic storage system 100 of the present invention, showing cryogenic tank 10, containment wall 12 defining impoundment area 15, emptying liquid LNG line 23, pump 25, and vaporizer 31 mounted on support structure 32 and positioned within impoundment area 15.

Figure 5:
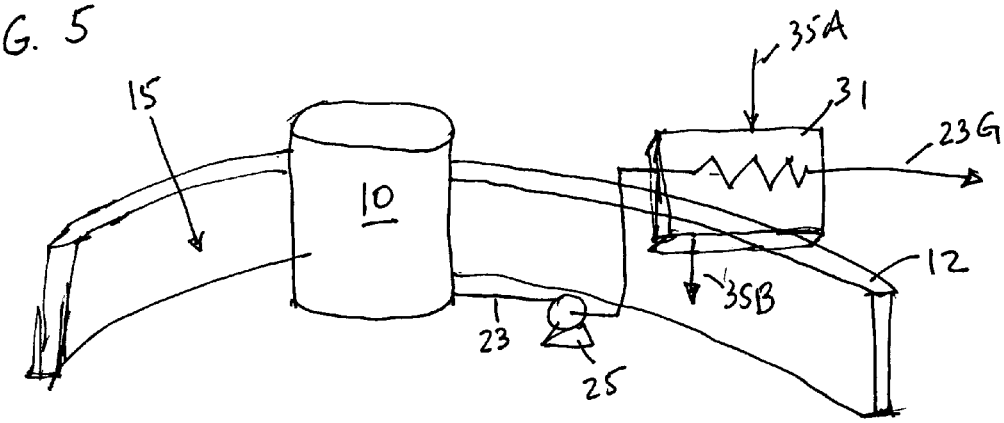
FIG. 5 is a schematic of another non-limiting embodiment of cryogenic storage system 100 of the present invention, showing cryogenic tank 10, containment wall 12 defining impoundment area 15, emptying liquid LNG line 23, pump 25, and vaporizer 31 mounted on containment wall 12.

More preferably, rather than providing a separate support structure for vaporizer 31, it is mounted on containment wall 12 as shown in FIG. 5.

Even more preferably, vaporizer 31 is mounted in a convenient position on containment wall 12.

As shown in FIG. 3, another embodiment of the method of the present invention, includes pumping the cryogenic fluid away from the tank in which it is stored, vaporizing the cryogenic fluid with a heat transfer medium in a manner sufficient to forming a cooled heat transfer medium, and then discharging this cooled heat transfer medium into the impoundment area around the tank. Optional method steps include a partial or full by-pass of the vaporizer.

Figure 4:
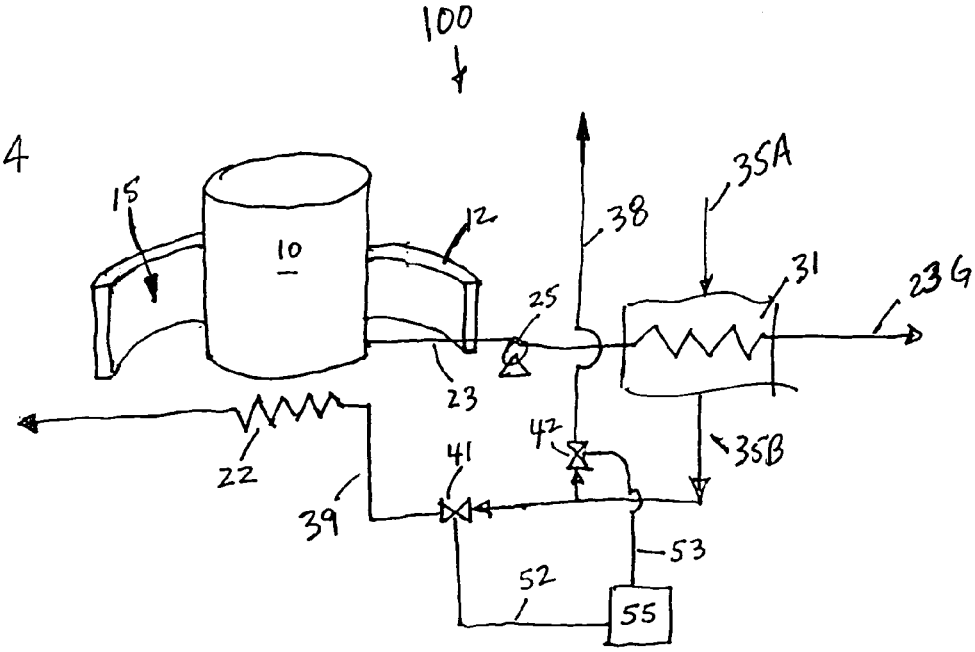
FIG. 4 shows a schematic representation of even another non-limiting embodiment of cryogenic storage system 100 of the present invention, showing cryogenic tank 10, containment wall 12 defining impoundment area 15, emptying liquid LNG line 23, pump 25, and vaporizer 31.

Referring now to FIG. 4, there is shown even another non-limiting embodiment of cryogenic storage system 100 of the present invention, showing cryogenic tank 10, containment wall 12 defining impoundment area 15, emptying liquid LNG line 23, pump 25, and vaporizer 31.

As in the above embodiments, pump 25 is engaged to pump liquid LNG to be vaporized through emptying line 23 to vaporizer 31. Heat necessary to vaporize the LNG is provided by inlet line 35A carrying the heat exchange medium (which in this embodiment is preferably a liquid, most preferably water or an aqueous solution). Vaporizer 31 is operated in such a manner that the cooled heat exchange medium stream 35B still has sufficient heat for further uses. Thus, outlet piping stream splits into cooled heat exchange medium stream 38, which is most likely heated and then recycled to vaporizer 31, and cooled heat exchange medium stream 39 is circulated beneath tank 10 thru heater 22, and then also most likely heated and then recycled to vaporizer 31.

Optionally, valves 42 and 41 may be provided to regulate streams 38 and 39, respectively. Control of valves 42 and 41 may be manual, or by optional controller 55, shown in communication with valves 42 and 41 by communication lines 53 and 52, respectively (although wireless signals may also be utilized).

As shown in FIG. 4, even another embodiment of the method of the present invention, includes pumping the cryogenic fluid away from the tank in which it is stored, vaporizing the cryogenic fluid with a heat transfer medium in a manner sufficient to forming a cooled heat transfer medium, and then discharging a first portion of the cooled heat transfer medium outside the impoundment area around the tank, and contacting a second portion of the cooled heat transfer medium with the ground beneath the tank.

It is anticipated, that cryogenic system 100 of the present invention may be incorporated into an LNG transportation system, most notably to store LNG at locations remote to the LNG plant while it awaits subsequent use or further transportation. For example, one or more cryogenic systems 100 make be incorporated into an LNG terminal that receives LNG from marine vessels, rail, truck, air, or other transport.

The cryogenic storage system 100 of the present invention may also find utility when incorporated into an LNG plant, specifically for storing the output of an LNG plant.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which this invention pertains.

I claim:

1. An apparatus comprising:

a tank positioned on a foundation;

a vaporizer in liquid communication with the tank, and further comprising a heat exchange medium inlet stream, and a heat exchange medium outlet stream;

wherein, the heat exchange medium outlet stream is routed through the foundation, and, wherein at least a portion but not all of the heat exchange medium inlet stream is routed through the foundation.

2. An apparatus comprising:

a tank positioned on a foundation;

a vaporizer in liquid communication with the tank and further comprising a heat exchange medium inlet stream, and a heat exchange medium outlet stream;

wherein, the heat exchange medium outlet stream is routed through the foundation, and further comprising a containment wall surrounding the tank, with the vaporizer supported by the containment wall.

3. An apparatus comprising:

a tank positioned on a foundation;

a vaporizer in liquid communication with the tank, and further comprising a heat exchange medium inlet stream, and a heat exchange medium outlet stream;

wherein, the heat exchange medium outlet stream is routed through the foundation, and further comprising a containment wall surrounding the tank and defining a containment area between the tank and wall, with the vaporizer positioned within the containment area.

4. The apparatus of claim 3, further comprising liquified natural gas contained within the tank.

5. An apparatus comprising:

a tank surrounded by a containment wall defining a containment area between the tank and wall;

a vaporizer in liquid communication with the tank, and further comprising a heat exchange medium inlet stream, and a heat exchange medium outlet stream;

wherein, the heat exchange outlet stream is routed to discharge into the containment area.

6. The apparatus of claim 5, wherein the tank is positioned on a foundation, the apparatus further comprising a blower positioned to intake from the containment area and to discharge through the foundation.

7. The apparatus of claim 5, wherein the vaporizer is supported by the containment wall.

8. The apparatus of claim 5, wherein the vaporizer is positioned in the containment area.

9. The apparatus of claim 5, further comprising liquified natural gas contained within the tank.

10. An apparatus comprising:

a tank positioned on a foundation, and surrounded by a containment wall defining a containment area between the tank and wall;

a vaporizer in liquid communication with the tank, and further comprising a heat exchange medium inlet stream, and a heat exchange medium outlet stream;

wherein, a first portion of the heat exchange outlet stream is routed through the foundation, and a second portion of the heat exchange outlet stream is routed to discharge outside the containment area.

11. The apparatus of claim 10, wherein the vaporizer is mounted on the containment wall.

12. The apparatus of claim 10, wherein the vaporizer is positioned in the containment area.

13. The apparatus of claim 10, wherein at least a portion but not all of the heat exchange medium inlet stream is routed through the foundation.

14. The apparatus of claim 10, further comprising liquified natural gas contained within the tank.

15. A method of vaporizing a cryogenic liquid contained within a tank positioned on a foundation, the method comprising;

passing the cryogenic liquid from the tank to a vaporizer;

introducing an inlet stream comprising heat exchange medium into the vaporizer to gasify the cryogenic liquid and cool the heat exchange medium;

passing the cooled heat exchange medium through the foundation; and comprising passing at least a portion by not all of the inlet stream through the foundation.

16. The method of claim 15, wherein the cryogenic liquid is liquified natural gas.

17. A method of vaporizing a cryogenic liquid contained within a tank supported by a foundation and surrounded by a wall defining a containment area between the tank and the wall, the method comprising;

passing the cryogenic liquid from the tank to a vaporizer;

introducing an stream comprising a heat exchange medium into the vaporizer to gasify the cryogenic liquid and cool the heat exchange medium; and, discharging the cooled heat exchange medium stream into the containment area.

18. The method of claim 17, further comprising passing at least a portion by not all of the inlet stream through the foundation.

19. The method of claim 17, further comprising blowing air from the containment area through the foundation.

20. The method of claim 17, wherein the cryogenic liquid is liquified natural gas.

21. A method of vaporizing a cryogenic liquid contained within a tank supported by a foundation, and surrounded by a wall defining a containment area between the tank and the wall, the method comprising;

passing the cryogenic liquid from the tank to a vaporizer;

introducing an inlet steam comprising a heat exchange medium into the vaporizer to gasify the cryogenic liquid and cool the heat exchange medium;

passing a first portion of the cooled heat exchange medium through the foundation; and, discharging a second portion of cooled heat exchange medium stream outside of the containment area.

* * * * *